US010851756B1

(12) United States Patent
Pranger

(10) Patent No.: US 10,851,756 B1
(45) Date of Patent: Dec. 1, 2020

(54) DRILL ASSIST START FOR A SMALL COMBUSTION ENGINE

(71) Applicant: Leslie J. Pranger, Corunna, IN (US)

(72) Inventor: Leslie J. Pranger, Corunna, IN (US)

( * ) Notice: Subject to any disclaimer, the term of this patent is extended or adjusted under 35 U.S.C. 154(b) by 0 days.

(21) Appl. No.: 16/411,625

(22) Filed: May 14, 2019

(51) Int. Cl.

| | |
|---|---|
| ***F02N 11/12*** | (2006.01) |
| ***F02N 3/02*** | (2006.01) |
| ***F02N 15/06*** | (2006.01) |
| *F02N 3/00* | (2006.01) |
| *F02N 19/00* | (2010.01) |
| *F02N 1/00* | (2006.01) |

(52) U.S. Cl.
CPC ..... *F02N 11/12* (2013.01); *F02N 3/02* (2013.01); *F02N 15/068* (2013.01); *F02N 1/00* (2013.01); *F02N 3/00* (2013.01); *F02N 19/00* (2013.01); *F02N 19/001* (2013.01)

(58) Field of Classification Search
CPC ..... F02N 11/12; F02N 3/02
USPC ..... 123/185.3, 185.4
See application file for complete search history.

(56) References Cited

U.S. PATENT DOCUMENTS 2,939,448 A * 6/1960 Hansen ..... F02N 11/00 123/179.24
3,219,021 A * 11/1965 Mercer ..... F02N 3/02 123/179.24
4,157,083 A * 6/1979 Smith ..... F02N 3/02 123/179.24
4,615,311 A * 10/1986 Scheckel ..... F02N 11/12 123/179.24
4,756,692 A * 7/1988 Pranger ..... A47G 33/00 273/457
4,909,200 A * 3/1990 Sumi ..... F02N 3/02 123/179.24
6,253,722 B1 * 7/2001 Robinson ..... F02N 3/02 123/179.24
6,397,774 B1 * 6/2002 Pranger ..... B63B 17/02 114/263
6,595,090 B1 * 7/2003 McQuillin ..... B25B 27/0035 123/179.26
6,915,773 B2 * 7/2005 Smith ..... F02N 3/02 123/179.26
7,331,321 B2 * 2/2008 Thompson ..... F02N 11/12 123/179.24
7,343,891 B1 * 3/2008 Chang ..... F02N 3/02 123/185.3
7,748,360 B2 * 7/2010 Thompson ..... F02N 15/006 123/185.3
9,587,615 B2 * 3/2017 Koehler ..... F02N 11/12
10,233,890 B2 * 3/2019 Ma ..... F02N 3/02
10,400,669 B2 * 9/2019 Liu ..... F02N 11/0851
(Continued)

FOREIGN PATENT DOCUMENTS

JP 2006336522 A * 12/2006 ..... F02N 3/02

*Primary Examiner* — Kevin R Steckbauer
(74) *Attorney, Agent, or Firm* — Taylor IP, P.C.

(57) ABSTRACT

A small combustion engine mechanism including an engine, a driven device powered by the engine. The engine having a ratcheting reel mechanism, a recoil starter housing, a shaft member coupled to the reel mechanism, and a bearing member coupled to the recoil starter housing. The shaft member being supported by the bearing member. The engine also has a tool engaging member coupled to the shaft member, the tool engaging member being accessible to a tool driver.

17 Claims, 3 Drawing Sheets

(56) References Cited

U.S. PATENT DOCUMENTS

| | | | | |
|---|---|---|---|---|
| 2002/0139341 | A1* | 10/2002 | Tsuno | F02N 3/02 123/185.3 |
| 2004/0244754 | A1* | 12/2004 | Smith | F02N 11/12 123/179.24 |
| 2007/0000466 | A1* | 1/2007 | Thompson | F02N 15/006 123/179.24 |
| 2008/0047518 | A1* | 2/2008 | Chang | F02N 11/12 123/185.3 |
| 2008/0127930 | A1* | 6/2008 | Thompson | F02N 11/12 123/185.3 |
| 2018/0209391 | A1* | 7/2018 | Ma | F02N 1/02 |

* cited by examiner

DRILL ASSIST START FOR A SMALL COMBUSTION ENGINE

FIELD OF THE INVENTION

The present invention relates to a starting assist mechanism for a small combustion engine.

BACKGROUND OF THE INVENTION

A recoil start engine, which can also be referred to as a manual start, a pull start or a rewind start, is a method of starting a small internal combustion engine. Such an engine is usually associated with small machines, such as lawn mowers, chainsaws, weed eaters, small outboard motors, portable generators, as well as small vehicles such as small go-karts, minibikes, snowmobiles and small ATVs.

Some legacy motors actually use a pull starter that has a slotted reel directly connected to the crankshaft, and a rope is inserted into the slot, and it is wound around the reel and is then pulled to start the engine. Once the end of the pull is reached, the rope comes free from the reel, leaving the now disconnected rope in the person's hand. If the engine fails to start on the first pull, the operator has to re-wind the rope onto the reel by hand.

A typical recoil start engine has a starter mechanism made up of a rope, with a grip at the end, a molded rope reel and a spring. The rope is coiled about the reel which is held under tension by the spring. This reel assembly is in contact with one end of the crankshaft through a ratcheting mechanism, such as a freewheeling clutch. When the rope's grip is pulled, the rope uncoils turning the reel, tensioning the spring, and engaging the clutch, which turns the crankshaft. The spinning of the crankshaft allows the engine to start, hopefully before the end of the pull stroke. After the end of the pull is reached, whether or not the engine has started, the spring operated reel retracts the rope, in order to prepare the starter mechanism for another attempt to start and disengages the clutch hence the term "re-coil starter". Once the rope reaches the end of its travel and/or the engine starts, the freewheel mechanism disengages the reel so that it is not driven by the engine.

Some small engines have an easy start feature which serves to hold the valves of the engine open by way of a cam while the rope is being pulled, avoiding the need to overcome the compression of the cylinders. The cam is deactivated at the end of the "pull" to activate the valves so that the engine can fire and run by itself. Even this easy start feature can be difficult for some people to accomplish if they have limited movement or strength of their arms, or if they suffer from joint issues.

What is needed in the art is a mechanism and a method of starting a small engine without the need to pull a rope starting system.

SUMMARY OF THE INVENTION

Exemplary embodiments of the present invention provide for the installation of a kit into a small internal combustion engine so that a drill can be used to start the engine.

In accordance with an aspect of the present invention, there is provided a small combustion engine mechanism including an engine, a driven device powered by the engine. The engine having a ratcheting reel mechanism, a recoil starter housing, a shaft member coupled to the reel mechanism, and a bearing member coupled to the recoil starter housing. The shaft member being supported by the bearing member. The engine also has a tool engaging member coupled to the shaft member, the tool engaging member being accessible to a tool driver.

In accordance with another aspect of the present invention, there is provided a small combustion engine starting device. The engine having a ratcheting reel mechanism, and a recoil starter housing. The starting device having a shaft member coupled to the reel mechanism, and a bearing member coupled to the recoil starter housing. The shaft member being supported by the bearing member. The engine also has a tool engaging member coupled to the shaft member, the tool engaging member being accessible to a tool driver.

In accordance with another aspect of the present invention, there is provided a small combustion engine starting device kit. The kit having a shaft member couplable to the reel mechanism of the engine, and a bearing member couplable to the recoil starter housing of the engine. The shaft member being supported by the bearing member. The kit also has a tool engaging member coupled to the shaft member, the tool engaging member being accessible to a tool driver.

BRIEF DESCRIPTION OF THE DRAWINGS

For the purpose of illustration, there are shown in the drawings certain embodiments of the present invention. It should be understood, however, that the invention is not limited to the precise arrangements, dimensions, and instruments shown. Like numerals indicate like elements throughout the drawings. In the drawings.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
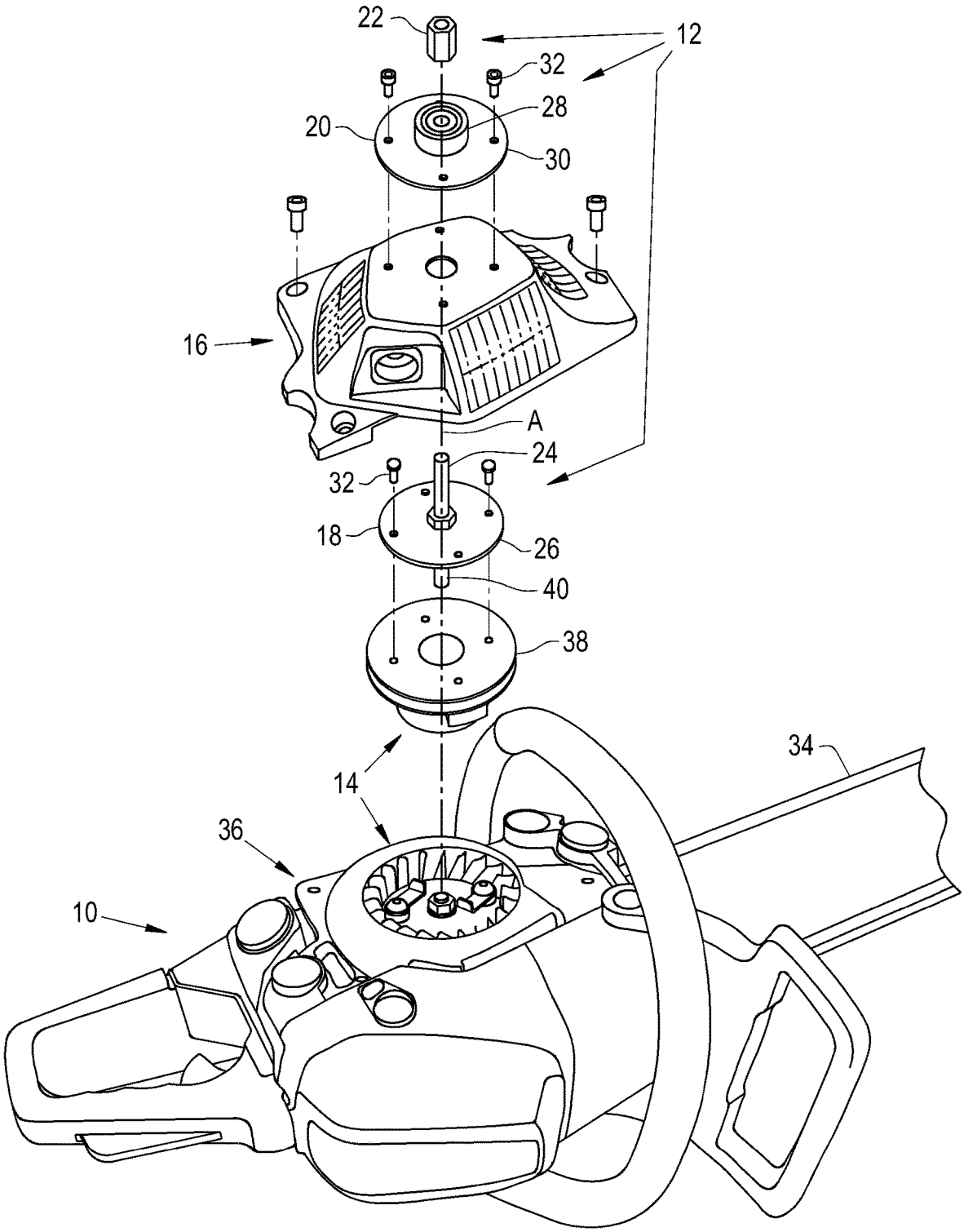
FIG. 1 is a perspective exploded view of one embodiment of the starting assist device of the present invention installed in a chainsaw.

Referring now to the drawings, and more particularly to FIG. 1, there is shown an exemplary embodiment of a chainsaw 10, having a small combustion engine starting device 12 of the present invention. Chainsaw 10 has a ratcheting reel mechanism 14, and a recoil starter housing 16 with which engine starting device 12 is coupled. The starting device 12 has a shaft member 18 coupled to reel mechanism 14, and a bearing member 20 coupled to recoil starter housing 16. Shaft member 18 is supported by bearing member 20. A tool engaging member 22 is coupled to shaft member 18, the tool engaging member 22 being accessible to a tool driver D as shown in FIG. 2.

Shaft member 18 includes shafts 24 and 40 that are coupled to a plate 26. One end of shaft 24 is perpendicularly connected to the surface of plate 26 relative to longitudinal axis A, and one end of shaft 40 is coupled to an opposite side of plate 26 coaxially with axis A. Shafts 24 and 40 may be integral with each other and plate 26 may have a hole therein into which integral shaft 24/40 is inserted. Shaft 40 can interact with a bearing of reel mechanism 14 to thereby provide axial alignment of engine starting device 12 with the legacy parts of chainsaw 10. Bearing member 20 has a bearing 28 coupled to a plate 30 allowing shaft 24 to be inserted into bearing 28 which is supported thereby. Tool engaging member 22 is coupled to an end of shaft 24 to provide an interface with a tool held by driver D. Fasteners 32 are used to respectively connect shaft member 18 to reel mechanism 14, and bearing member 20 to starter housing 16. Chainsaw 10 has a chain 34 that is driven by engine 36. While chainsaw 10 is used as an example, it is to be understood that engine 36 is representative of any small internal combustion engine 36, which is used to drive a driven device 34.

While bearing member 20 is illustrated as being installed on an outer surface of housing 16, it is also contemplated that bearing member 20 could be installed on an inner surface of housing 16. Further, while tool engaging member 22 is illustrated as being a male feature that interacts with a female oriented tool held by drill D, it is also contemplated that tool engaging member 22 can be oriented as a female device and can even be recessed into bearing 28, which would be engaged with a male tool in driver/drill D.

Figure 2:
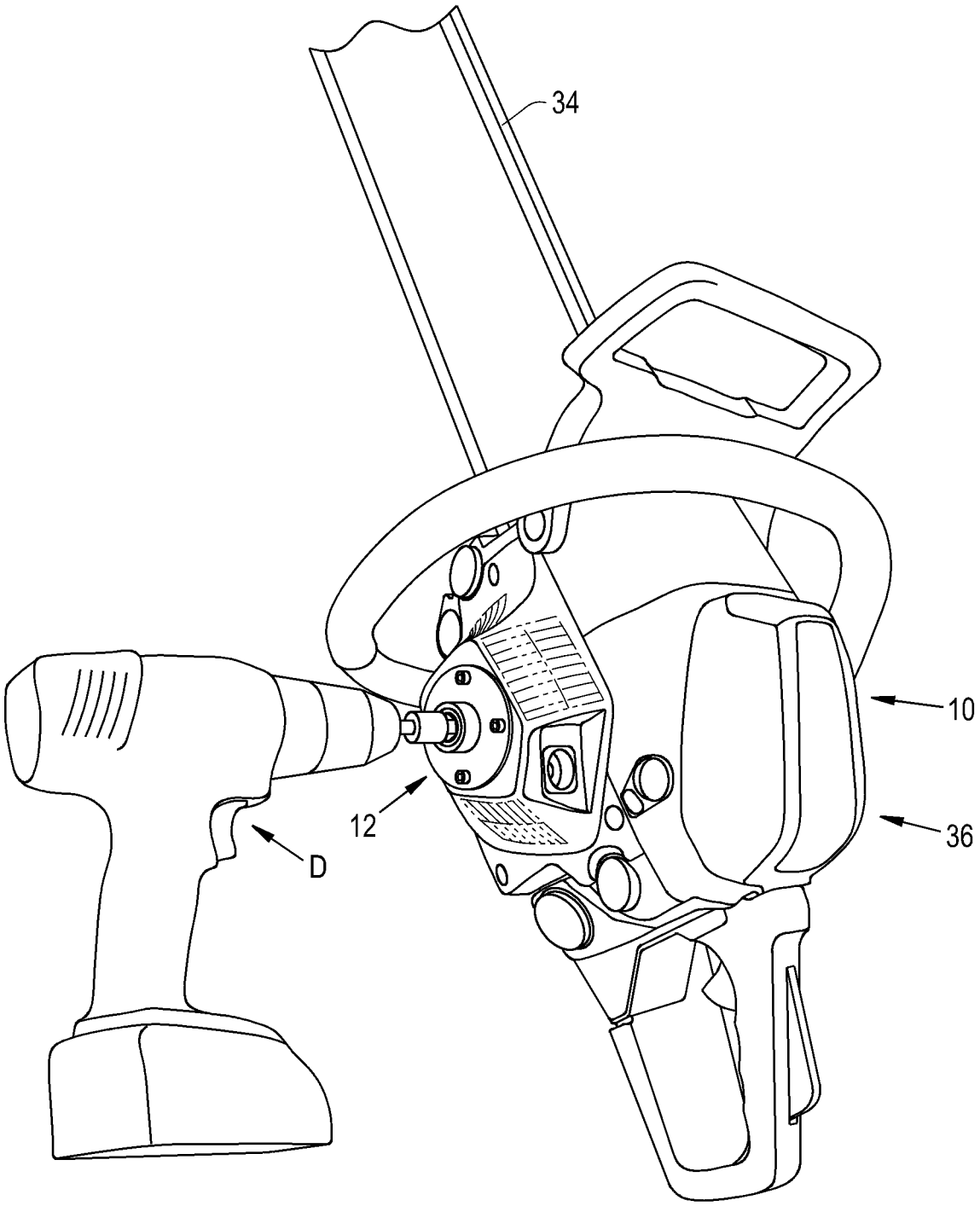
FIG. 2 is a perspective view of the installed starting assist device being used by a battery powered drill to start the chainsaw of FIG. 1.

Now, additionally referring to FIG. 2, chainsaw 10 is shown with starting device 12 being coupled thereto such that driver/drill D is being used to drivingly engage tool engaging member 22 and drill D is activated causing engine 36 to crank so that engine 36 starts, at which point drill/driver D is pulled away from starting device 12 and then saw 10 can be used for an intended purpose.

Advantageously, the present invention uses the ratcheting reel mechanism 14 of the saw, which serves to disengage the rotating crankshaft of engine 36 once engine 36 starts. The reel mechanism 14 includes the annular groove 38 where a rope would go, had chainsaw 10 not been converted, hence using as many parts from the prior art saw as is possible. Further, the use of driver/drill D provides flexibility in the starting of engine 36 and does not burden the weight of chainsaw 10 during operation of chainsaw 10.

Figure 3:
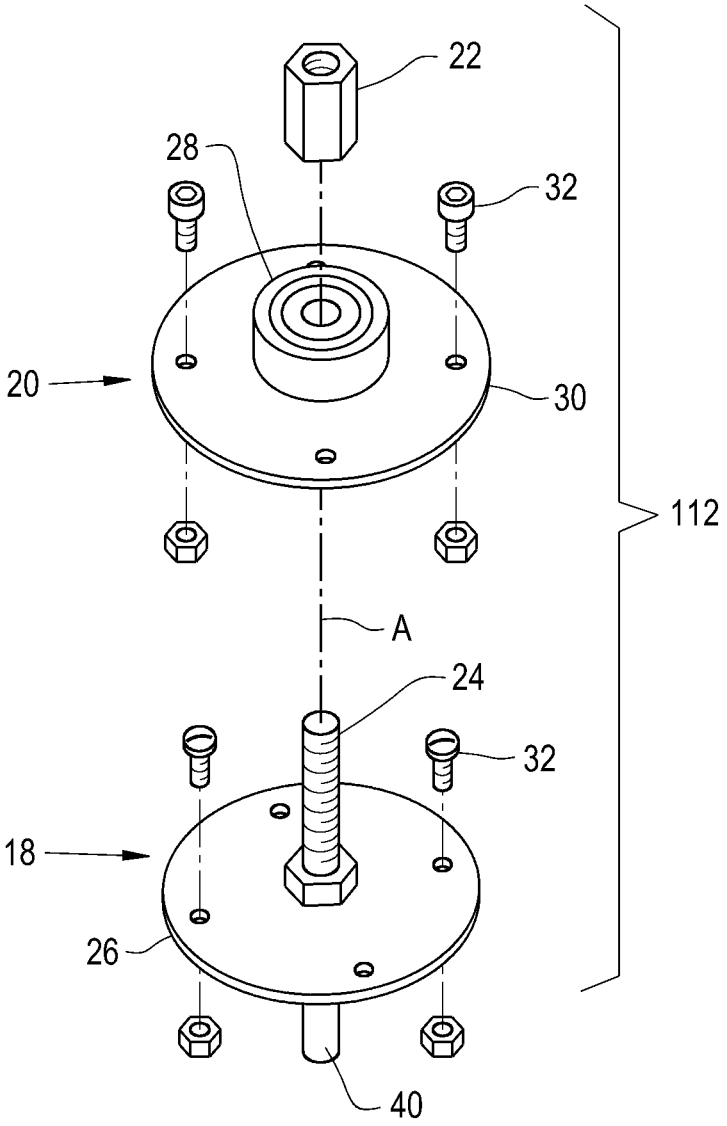
FIG. 3 is an exploded perspective view of the starting assist device of the present invention in a kit form.

Now, additionally referring to FIG. 3, there is shown a kit 112, that include the parts of starting device 12, so the kit 112 can be provided as an item for sale thereby allowing a retrofit of a legacy engine 36 housing 16 and reel 14. In order to install kit 112 housing 16 is removed from engine 36, along with the removal of a rope that would reside in groove 38, and the removal of the recoil spring that is often associated with a reel mechanism 14. Then reel 14 is modified to accept fasteners facilitating the attachment of shaft member 18 thereto. Bearing member 20 is, in a similar manner, coupled to housing 16 and installed back on saw 10 with shaft 24 then resting in bearing 28. Tool engaging member 22 is then coupled to shaft 24 to allow the transmission of rotational movement from driver/drill D to the crankshaft of engine 36.

It is also contemplated that the present invention may be added to a rope starting system to thereby allow the starting of the engine with either the pulling of the rope starting system or by use of the small combustion engine starting device 12. This allows the user to use either method to start the small engine. For example, using the small combustion engine starting device 12 may be advantageous when the engine is cold, to initially get the engine running; then later should the engine stall or be shut off, using the rope starter to restart the engine, which should be easier than when the engine was cold.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A small combustion engine mechanism, comprising:
an engine;
a driven device powered by the engine;
wherein the engine includes:
a ratcheting reel mechanism;
a recoil starter housing;
a shaft member coupled to the reel mechanism, the shaft member including a plate extending radially outward from a longitudinal axis of the shaft member, the plate being rigidly coupled to the reel mechanism;
a bearing member coupled to the recoil starter housing, the shaft member being supported by the bearing member; and
a tool engaging member coupled to the shaft member, the tool engaging member being accessible to a tool driver.

2. The small combustion engine mechanism of claim 1, wherein the reel mechanism has an annular groove thereabout.

3. The small combustion engine mechanism of claim 1, wherein the bearing member is coupled to one of an inside and an outside of the recoil starter housing.

4. The small combustion engine mechanism of claim 3, wherein the bearing member is coupled to the outside of the recoil starter housing.

5. The small combustion engine mechanism of claim 1, wherein the tool engaging member is recessed in the bearing or extends from the bearing.

6. The small combustion engine mechanism of claim 5, wherein the tool engaging member extends from the bearing.

7. The small combustion engine mechanism of claim 1, wherein the shaft member includes a shaft, the plate being on one end of the shaft, the tool engaging member being coupled to an other end of the shaft, the tool engaging member extending from the bearing.

8. A small engine starting device for a small engine, the small engine having a ratcheting reel mechanism and a recoil starter housing, the starting device comprising:
a shaft member configured for coupling to the ratcheting reel mechanism, the shaft member including a plate extending radially outward from a longitudinal axis of the shaft member, the plate being configured for rigidly coupling to the ratcheting reel mechanism;
a bearing member configured for coupling to the recoil starter housing, the shaft member being supported by the bearing member; and
a tool engaging member coupled to the shaft member, the tool engaging member being accessible to a tool driver.

9. The small engine starting device of claim 8, wherein the bearing member is configured for coupling to one of an inside and an outside of the recoil starter housing.

10. The small engine starting device of claim 9, wherein the bearing member is configured for coupling to just the outside of the recoil starter housing.

11. The small engine starting device of claim 8, wherein the tool engaging member is recessed in the bearing or extends from the bearing.

12. The small engine starting device of claim 11, wherein the tool engaging member extends from the bearing.

13. The small combustion engine mechanism of claim 8, wherein the shaft member includes a shaft, the plate being on one end of the shaft, the tool engaging member being coupled to an other end of the shaft, the tool engaging member extending from the bearing.

14. A small engine starting device kit, the kit being installable on a small engine having a ratcheting reel mechanism and a recoil starter housing, the kit comprising:

a shaft member configured for coupling to the ratcheting reel mechanism, the shaft member including a plate extending radially outward from a longitudinal axis of the shaft member, the plate being configured for rigidly coupling to the ratcheting reel mechanism;

a bearing member couplable to the recoil starter housing, the shaft member being supportable by the bearing member; and a tool engaging member couplable to the shaft member, the tool engaging member being accessible to a tool driver.

15. The small engine starting device kit of claim 14, wherein the bearing member is couplable to one of an inside and an outside of the recoil starter housing.

16. The small engine starting device kit of claim 15, wherein the bearing member is couplable to just the outside of the recoil starter housing.

17. The small engine starting device kit of claim 16, wherein the tool engaging member extends from the bearing when installed on the small engine.

* * * * *